United States Patent [19]

Evers

[11] Patent Number: 4,850,416

[45] Date of Patent: Jul. 25, 1989

[54] SLAT SHADE OPERATOR

[75] Inventor: Robert S. Evers, Pella, Iowa

[73] Assignee: Rol Screen Company, Pella, Iowa

[21] Appl. No.: 176,470

[22] Filed: Apr. 1, 1988

[51] Int. Cl.[4] ..... E05F 11/00

[52] U.S. Cl. ..... 160/188; 160/107; 160/168.1; 160/177

[58] Field of Search ..... 160/107, 188, 168.1, 160/178.1, 900, 181, 166.1, 177

[56] References Cited

U.S. PATENT DOCUMENTS

| | | | |
|---|---|---|---|
| 2,498,079 | 2/1950 | Hunter | 160/177 |
| 2,889,591 | 6/1959 | Pratt | 160/107 X |
| 3,722,572 | 3/1973 | Hall | 160/107 |
| 4,245,687 | 1/1981 | Vecchiarelli | 160/177 |
| 4,274,469 | 6/1981 | Kuyper et al. | 160/107 |
| 4,457,351 | 7/1984 | Anderson | 160/178.1 |
| 4,616,688 | 10/1986 | Agos | 160/178.1 X |

*Primary Examiner*—Blair M. Johnson
*Assistant Examiner*—D. Kolman

[57] ABSTRACT

A between-the-glass slatted blind operator includes an enclosure having a housing and a bottom wall. All of the gears are contained in the housing and the bottom wall is placed over the top of the gears when the operator is being assembled and being locked in place by inwardly deflected tabs on the housing side walls. The bottom wall has upwardly extending gear supports which oppose the gear supports in the housing. The bottom wall is unexposed to view when the operator is in its position of use.

11 Claims, 3 Drawing Sheets

SLAT SHADE OPERATOR

BACKGROUND OF THE INVENTION

Rolscreen Company, Pella, Iowa, markets a Slimshade between the glazing-slatted blind operated by an operator on the window frame on the room side, as seen in U.S. Pat. No. 4,274,469, June 23, 1981. This operator includes an enclosure formed from two half housing sections which interface at a longitudinal plane therebetween. A screw interconnects the two housing half sections and a wood screw extends through the housing half sections into the wooden window frame.

While this operator has worked well, it is costly to manufacture as it is difficult to assemble since parts must be positioned in each of the half sections before they are put together. Both of the housing half sections must be treated on their exterior with paint or other finish since they are both exposed and visible. Further, for purposes of withstanding occasional abuse by users of the operators, a strengthened operator is desirable.

SUMMARY OF THE INVENTION

The slat shade operator of this invention is of a simplified construction requiring less time to assemble and is stronger to withstand abuse. All of the component parts are placed in a housing inverted from its use position and a bottom wall is placed on the housing whereupon downward extending tabs on the opposite side walls of the housing are deflected laterally along the bottom face of the bottom wall to lock it in place between the side walls and end wall of the housing. The bottom wall is obscured from view when in use in the corner of a window frame.

The bottom wall carries supports for each of the input, transfer and output gears which oppose supports in the housing to hold the gears in their desired positions for operation. The supports on the bottom wall for the input and output gears extend upwardly past the transfer gear, and in the case of the output gear, are on one side only of the transfer gear.

Only the housing component of this operator need be painted or finished on its exterior surface as the bottom wall is not exposed to view. A mounting tab in the substantial plane of the bottom wall is utilized to secure the operator to the window frame through the use of a wood screw. Penetrating tabs on the bottom wall and housing at the opposite end are embedded in the stile of the window frame.

DESCRIPTION OF THE DRAWINGS

FIG. 9 is a perspective view of the top of the bottom wall of the operator enclosure.

DESCRIPTION OF THE PREFERRED EMBODIMENT

Figure 1:
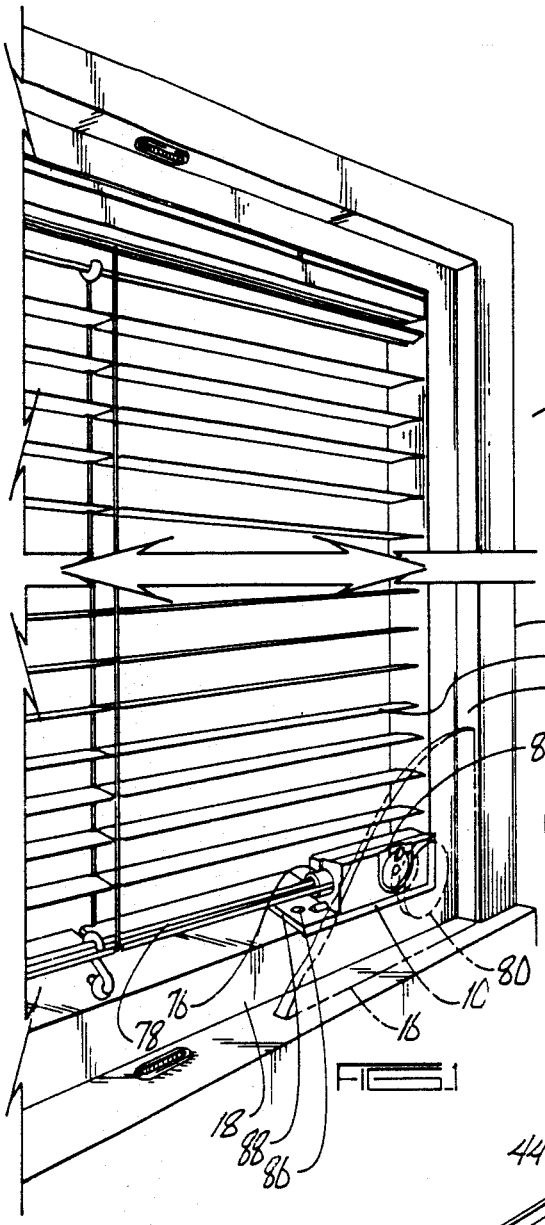
FIG. 1 is a fragmentary perspective view of the operator of this invention on a window frame for operating a slatted shade between panes of glass.
Figure 2:
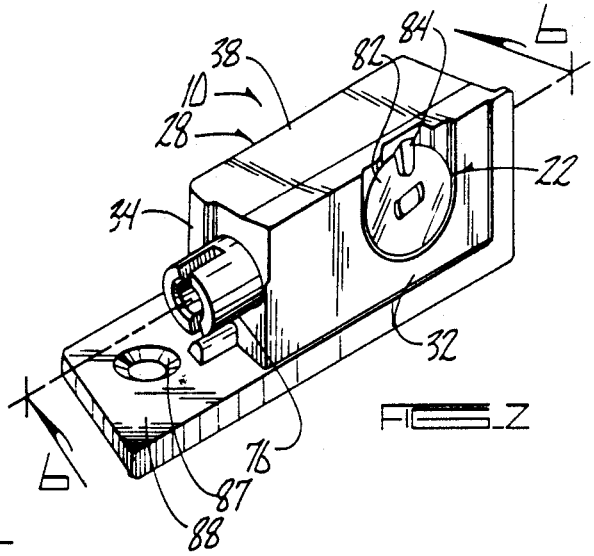
FIG. 2 is a perspective view of the operator.

The operator of this invention is referred to generally by the reference numeral 10 in FIGS. 1 and 2. The operator is shown in a window 12 having a slatted shade 14 between panes of glass 16. The operator is mounted in a bottom right-hand corner of a window frame on the lower rail 18 and against the vertical stile 20.

Figure 3:
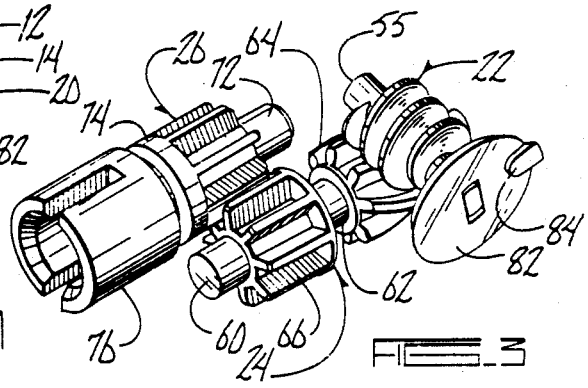
FIG. 3 is a perspective view of the gear train in the operator.
Figure 4:
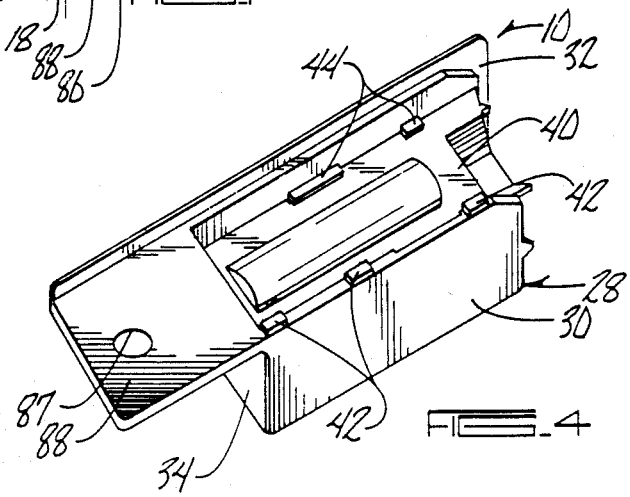
FIG. 4 is a bottom perspective view of the operator.
Figure 6:
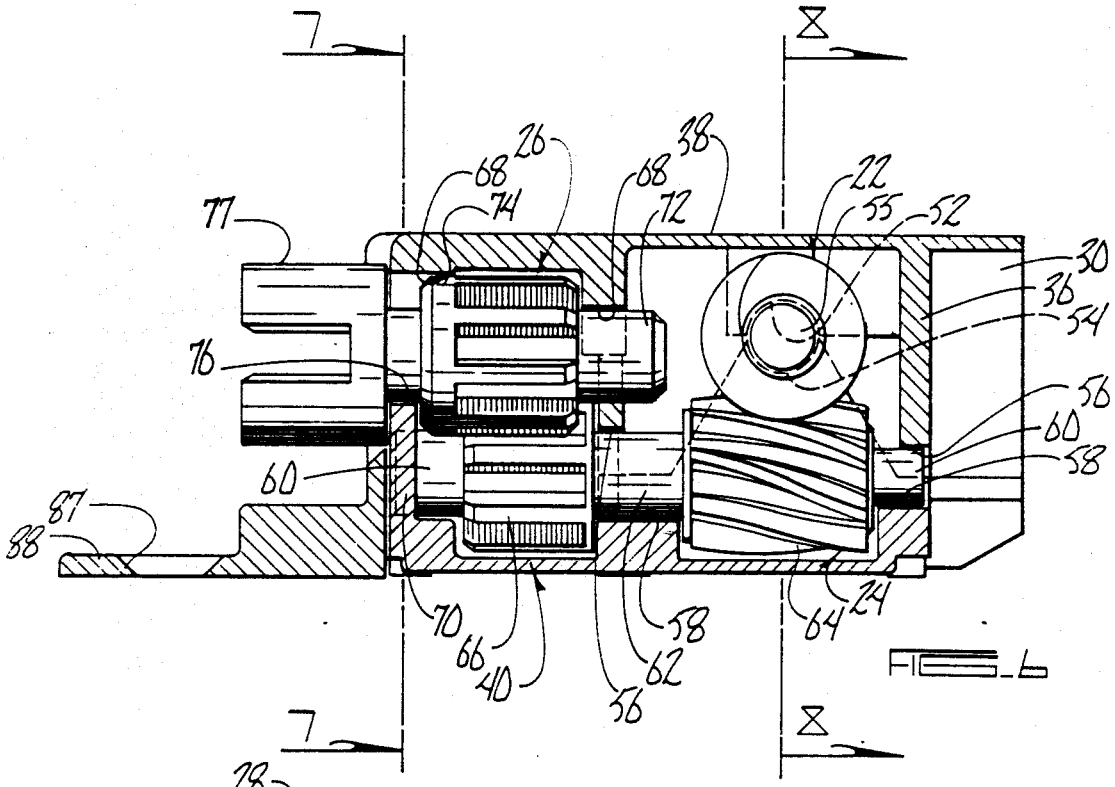
FIG. 6 is a longitudinal cross-sectional view through the operator.
Figure 7:
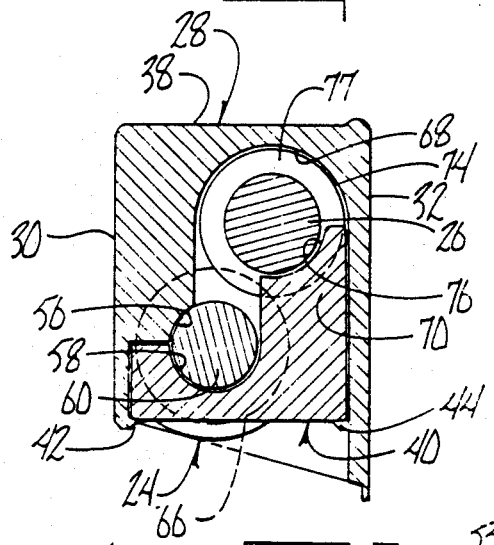
Figure 8:
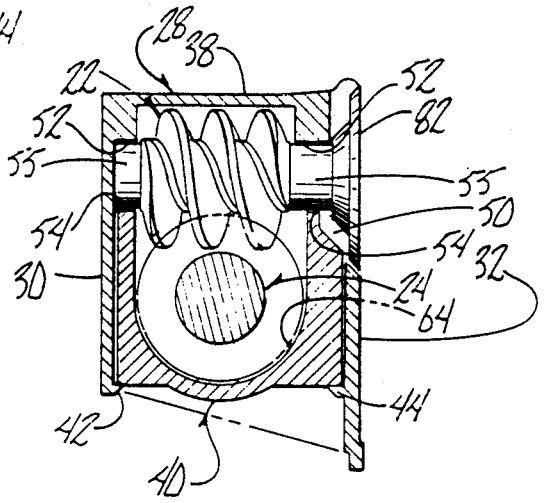
FIG. 8 is a cross-sectional view taken along Line 8—8 in FIG. 6.

As seen in FIG. 3, an input gear 22 drives a transfer gear 24 connected to an output gear 26. The operator includes an enclosure comprising a housing 28 having opposite side walls 30 and 32 and opposite end walls 34 and 36 (see FIG. 6). As seen in FIG. 2, a top wall 38 is provided.

A bottom wall 40 is positioned between the opposite side walls 30 and 32 and is totally obscured when the operator is in its position of use, as seen in FIG. 1. The bottom wall 40 is locked in place by downwardly extending tabs 42 on side wall 30 which are deflected laterally across the lower side of the bottom wall 40 when the operator is fully assembled. Upstanding tabs 44 on the lower ends of guide shoulders 46 on wall 32 are also deflected laterally over the bottom side of the bottom wall 40. Guide channels 48 are provided in the edge of the bottom wall 40 and receive the guide shoulders 46.

The housing side wall 32 includes an opening 50 through which the input gear 22 extends where it is supported on laterally spaced apart supports 52. The bottom wall has upwardly extending supports 54 on its opposite sides engaging the input gear shaft 55 at its opposite ends.

The transfer gear 24 is supported by supports 56 in the housing at opposite ends of the gear 24. Opposing supports 58 are provided on the top face of the bottom wall 40 at opposite ends and in the middle, as seen in FIG. 9, for engaging the opposite extending stub shafts 60 and the shaft portion 62 in the middle between diagonal gear teeth 64 and gear teeth 66.

The output gear 26 extends through an opening in the end wall 34 of the housing 28 and is supported on longitudinally spaced apart supports 68. Upwardly extending output gear supports 70 are on one edge of the bottom wall 40 and engage the output drive shaft 72 at its inner end and in a channel race 74. The supports 70 have bearing surfaces 76 which engage the shaft 72 only on the bottom and one side as the supports extend past the transfer gear 24 on one side. The output drive gear 26 includes an adapter 77 on its outer end which engages the axial shaft of a bottom slat 78 of the blind 14.

A manually operated control 80 on the room side of the inner glass pane 16, as seen in FIG. 1, engages the adapter head 82 on the input gear 22 in locking fashion around the lug 84.

The operator 10 is secured in place on the window frame 12 by a screw 86 extending through an aperture 87 in the mounting tab 88 extending inwardly along the window frame in the plane of the bottom wall 40. Also, penetrating tabs 89 on the bottom wall and 89A on the housing side wall 30 are embedded in the stile of the window frame, as seen in FIGS. 1 and 3.

Figure 5:
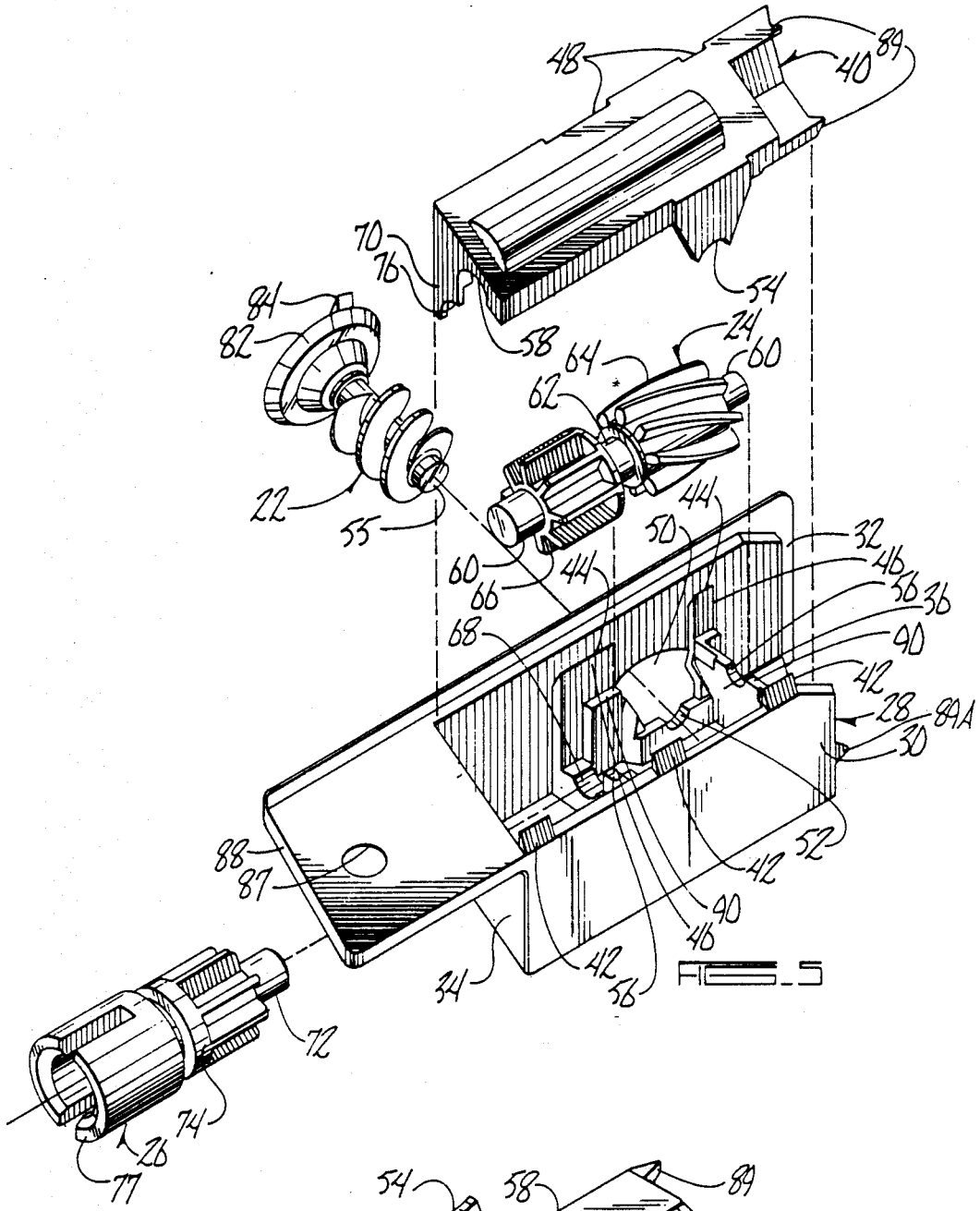
FIG. 5 is an exploded perspective view from the bottom of the operator.
Figure 7:
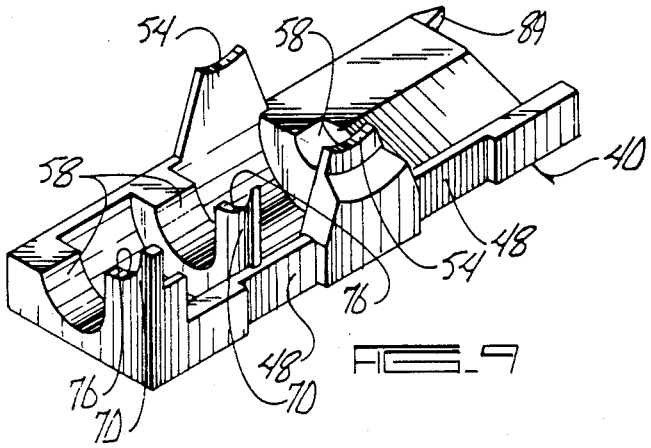
FIG. 7 is a cross-sectional view taken along Line 7—7 in FIG. 6.

Thus, it is seen in the assembly of the operator 10 in FIG. 5, it is inverted and then the input gear 22 and the output gear 26 are inserted through their respective wall openings followed by the transfer gear 24 being dropped in place on top of the input and output gears. The bottom wall 40 is then dropped in place on top of the gears and rests on shoulders 90 and the end wall 36. The tabs 42 and 44 are then deflected laterally inwardly across the bottom face of the bottom wall 40 thereby permanently locking the bottom wall 40 to the housing 28.

What is claimed is:

1. A slat shade operator comprising: an operator enclosure including a unitary housing having top walls, opposite end walls, and opposite side walls, said housing having an open bottom portion defining a cavity, said enclosure including a separable bottom wall positioned within said cavity between said opposite side walls and against one of said end walls and being recessed with respect to the bottom edges of said walls, thereby being obscured from sight when said operator is in an upright position of use in the corner of a window frame with said bottom wall on a rail of the frame and the other end wall being against a stile of the frame, and means releasably securing said bottom wall to said housing, one of said side walls having an opening entirely within said one side wall in which an input drive gear is positioned, said one end wall having an opening entirely within said one end wall in which an output drive gear is positioned, and a transfer gear is positioned longitudinally in said housing and engages at one end said input drive gear and at the other end said output drive gear.

2. The structure of claim 1 and a mounting tab extends from said one end wall adjacent said bottom wall.

3. The structure of claim 1 and said housing and bottom wall each having opposing supports for said input, output and transfer gears.

4. The structure of claim 3 wherein said supports on said bottom wall for said input gear are further defined as upwardly extending and spaced apart on opposite sides of said transfer gear and engaging opposite ends of said input gear.

5. The structure of claim 3 wherein said supports on said bottom wall for said output gear are further defined as being spaced apart extending upwardly past said transfer gear at opposite ends of said output gear and being disposed on only one side of said transfer gear.

6. The structure of claim 3 wherein said supports in said bottom wall for said transfer gear are further defined as including supports at opposite ends and in the middle engaging said transfer gear.

7. The structure of claim 1 wherein the opposite side walls of said housing include said securing means in the form of downwardly extending tabs deformed laterally inwardly under said bottom wall for locking said bottom wall in place on the bottom of said housing.

8. The structure of claim 7 wherein said bottom wall includes vertical channels on one side in which said tabs on one side wall of said housing extend.

9. The structure of claim 8 wherein the tabs on said other side wall of said housing are positioned on the bottom edge thereof below the plane of said bottom wall.

10. The structure of claim 2 and penetrating tabs are provided on the opposite end from said one end wall for being embedded in the window frame.

11. The structure of claim 10 wherein said penetrating tabs are positioned on said bottom wall and on said housing.

* * * * *